US006271491B1

(12) United States Patent
Ono et al.

(10) Patent No.: US 6,271,491 B1
(45) Date of Patent: Aug. 7, 2001

(54) PUSH BUTTON SWITCH INCLUDING DOME-SHAPED MOVABLE CONTACT HAVING REVERSE FUNCTION

(75) Inventors: Yutaka Ono; Naoya Iwama; Takeo Yamagata, all of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/564,923

(22) Filed: May 4, 2000

(30) Foreign Application Priority Data

May 10, 1999 (JP) ..... 11-128699

(51) Int. Cl.[7] ..... H01H 13/14

(52) U.S. Cl. ..... 200/520; 200/406; 200/341; 200/16 D

(58) Field of Search ..... 200/16 R–16 D, 200/402, 405, 406, 512, 516, 517, 520, 341

(56) References Cited

U.S. PATENT DOCUMENTS

| | | | | |
|---|---|---|---|---|
| 4,029,916 | | 6/1977 | Chu | 200/5 A |
| 4,194,105 | * | 3/1980 | Hodges | 200/159 B |
| 4,207,448 | * | 6/1980 | Furusawa et al. | 200/159 B |
| 4,476,355 | * | 10/1984 | Mital | 200/5 A |
| 4,611,261 | * | 9/1986 | Suwa | 361/399 |
| 4,933,522 | * | 6/1990 | Celander | 200/513 |
| 5,138,119 | | 8/1992 | Demeo | 200/5 A |
| 5,986,228 | * | 11/1999 | Okamoto et al. | 200/516 |

FOREIGN PATENT DOCUMENTS

| | | | |
|---|---|---|---|
| 2 054 268 A | 2/1981 | (GB) | H01H/13/48 |
| 10-134667 | 5/1998 | (JP) | H01H/13/48 |

* cited by examiner

*Primary Examiner*—Michael Friedhofer
(74) *Attorney, Agent, or Firm*—Brinks Hofer Gilson & Lione

(57) ABSTRACT

A dome-shaped movable contact having a reverse function used in a push button switch is disclosed, wherein it is possible that the movable contact comes into contact with a fixed contact at position excluding the central portion thereof where dust is liable to gather, obtains high contact reliability, has good feeling in manipulation and is excellent in an intimate contact property with a sheet member covering the movable contact. The push button switch includes fixed contacts, a dome-shaped movable contact disposed above the fixed contacts, and a projection formed on the inner surface of the movable contact at a portion excluding a dome-shaped apex portion so as to be in contact with and separated from one of the fixed contacts.

6 Claims, 3 Drawing Sheets

PUSH BUTTON SWITCH INCLUDING DOME-SHAPED MOVABLE CONTACT HAVING REVERSE FUNCTION

BACKGROUND OF THE INVENTION

1. Field of the Invention

The present invention relates to the structure of a push button switch used as a manipulating switch for various kinds of electronic equipment, and more particularly, to the structure of a dome-shaped movable contact having a reverse function.

2. Description of the Related Art

There are structures as shown in FIG. 5 to FIG. 7 as the structures of conventional push button switches. FIG. 5 is a sectional view of a housing type push button switch, FIG. 6 is a partially detailed view of a state in which a movable contact is in contact with a fixed contact, and FIG. 7 is a partially detailed view showing the movable contact and the fixed contacts of a sheet type push button switch.

In FIGS. 5 and 6, a housing 21 is formed of a molded material of a synthetic resin or the like in a box-shape with an upper surface opened, and fixed contacts 22 and 23, which are formed of a conductive metal such as brass or the like, are disposed on the inner bottom thereof. The fixed contacts 22 and 23 are buried in the housing 21 by a method of insert molding or the like, and connecting terminal 24 and 25, which extend externally of the housing 21, are formed at the other end sides of the fixed contacts 22 and 23.

A movable contact 26 is formed of a spring member such as stainless steel, phosphor bronze or the like in a reversible dome-shape, and the lower peripheral edge of the movable contact 26 is placed in the housing 21 in contact with one of the fixed contacts, that is, the fixed contact 22 disposed on the inner bottom of the housing 21. Further, the apex portion of the movable contact 26 is disposed in confrontation with the other fixed contact 23 with a predetermined interval therebetween, and a cylindrical projection 26*a*, which is formed in a cylindrical shape and projects upward, is disposed at the apex portion of the movable contact 26. The cylindrical projection 26*a* is formed integrally with the movable contact 26 with its bottom 26*b* facing upward and its peripheral edge 26*c* facing downward.

A stem 27 is formed of a molded material of a synthetic resin or the like and includes a press section 27*a* for pressing the dome-shaped apex portion of the movable contact 26, a locking section 27*b* locked to a cover 28 composed of a metal sheet and covering the opening of the housing 21 and a manipulating section 27*c* to be manipulated with a finger of an operator from the outside.

The operation of the above push button switch will be described. When the manipulating section 27*c* of the stem 27 is pressed and the stem 27 is pushed down thereby, the press section 27*a* presses the cylindrical projection 26*a* disposed at the apex portion of the movable contact 26 to thereby reverse the movable contact 26, so that the cylindrical projection 26*a* disposed at the apex portion comes into contact with the fixed contact 23. As a result, the fixed contact 22 is connected to the fixed contact 23 through the movable contact 26.

In this case, since the cylindrical projection 26*a*, which is formed in the cylindrical shape and projects upward, is disposed at the apex portion of the movable contact 26 and the peripheral edge 26*c* of the cylindrical projection 26*a* is in contact with the fixed contact 23, they are in contact with each other at a position from which dust 34, which tends to gather at the center 23*a* of the fixed contact 23, is avoided. Accordingly, the contact is stably performed and the reliability of the contact is enhanced as compared with the structure in which the apex portion is in direct contact with the center 23*a* of the fixed contact 23.

FIG. 7 shows a case in which the movable contact 26 is used in a sheet type push button switch. In the figure, a circuit board 28 is composed of an insulating laminated sheet formed of a phenol resin or the like, and fixed contacts 29 and 30, which are composed of an etched copper foil or the like, are disposed on the circuit board 28. The movable contact 26 is disposed on the fixed contacts 29 and 30, and the movable contact 26 is covered with a sheet member 31 formed of PET (polyethylene terephthalate) or the like. A spacer 32 is formed of an insulating material such as PET (polyethylene terephthalate) or the like in a sheet-shape and clamped between the circuit board 28 and the sheet member 31, thereby forming an accommodating section 32*a* in which the movable contact 26 is accommodated. Note that, although not shown, a plurality of the fixed contacts 29 and 30 and the movable contacts 26 are disposed on the circuit board 28.

While the above sheet type push button switch may be directly manipulated with a finger of an operator from above the sheet member 31, another stem (not shown) or the like may be disposed on the sheet member 31 and the push button switch may be manipulated through the stem.

However, in the structure of the movable contact 26 of the above conventional push button switch, the cylindrical projection 26*a* which projects upward is disposed at the apex portion of the dome-shaped movable contact 26 and is integrally coupled with the movable contact 26 with the bottom 26*b* thereof facing upward and the peripheral edge 26*c* thereof facing downward. Accordingly, since the interior of the movable contact 26 surrounded by the cylindrical projection 26*a* acts as a non-movable region when it is reversed, there is a problem that feeling in manipulation is adversely affected when the push button switch is manipulated.

Further, in the sheet type push button switch, since a gap 33 is made between the peripheral portion of the cylindrical projection 26*a* and the sheet member 31 by the existence of the cylindrical projection 26*a* which projects upward of the movable contact 26, an intimate contact property is bad and a problem resides in the reliability and outside appearance of a product.

Therefore, an object of the present invention is to solve the above problems and to provide the structure of a dome-shaped movable contact having a reverse function used in a push button switch, wherein it is possible that the movable contact comes into contact with a fixed contact at position excluding the central portion thereof where dusts is liable to gather, obtains high contact reliability, has good feeling in manipulation and is excellent in an intimate contact property with a sheet member covering the movable contact.

SUMMARY OF THE INVENTION

To solve the above problems, a first means of the present invention includes fixed contacts, a dome-shaped movable contact disposed above the fixed contacts, and a projection formed on the inner surface of the movable contact at a portion excluding a dome-shaped apex portion so as to be in contact with and separated from one of the fixed contacts.

A second means includes a housing, fixed contacts disposed on the inner bottom of the housing, a dome-shaped movable contact disposed above the fixed contacts, a stem movably disposed to the housing, and a projection formed on the inner surface of the movable contact at the portion excluding the dome-shaped apex portion so as to be in contact with and separated from one of the fixed contacts.

A third means includes a circuit board, fixed contacts disposed on the circuit board, a dome-shaped movable contact disposed above the fixed contacts, a sheet member adhered on the circuit board, and a projection formed on the inner surface of the movable contact at the portion excluding the dome-shaped apex portion so as to be in contact with and separated from one of the fixed contacts, wherein the movable contact is covered with the sheet member.

As a fourth means, a plurality of the projections are disposed on a dome-shaped inner surface in a scattered state.

Further, as a fifth means, the plurality of projections are disposed on an annular line.

DESCRIPTION OF THE PREFERRED EMBODIMENTS

Figure 1:
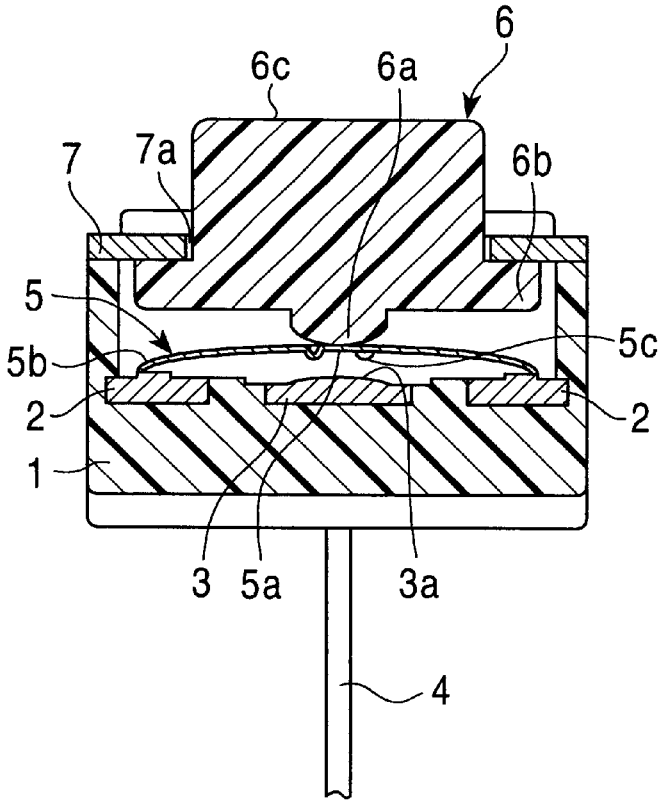
FIG. 1 is a sectional view showing the structure of a housing type push button switch as a first embodiment of the present invention.
Figure 2:
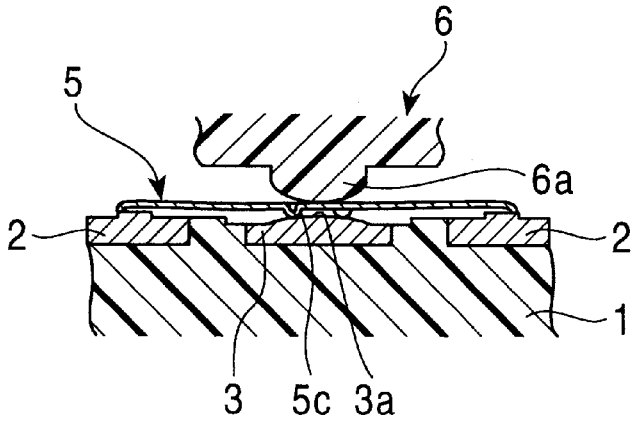
FIG. 2 is a partially detailed view showing a state in which the movable contact of the housing type push button switch of the present invention comes into contact with a fixed contact thereof.

Embodiments of the present invention will be described below with reference to FIG. 1 to FIG. 4. FIGS. 1 and 2 show the structure of a housing type push button switch as a first embodiment of the present invention, wherein FIG. 1 is a sectional view of the push button switch and FIG. 2 is a partially detailed view showing a state in which a movable contact comes into contact with a fixed contact.

In the figures, a housing 1 is formed of a molded material such as a synthetic resin or the like in a box shape with an upper surface opened. Fixed contacts 2 and 3, which are formed of a conductive metal material such as brass or the like, are disposed on the inner bottom of the housing 1 in the state that the surfaces thereof are exposed. Further, a pair of connecting terminals 4, which project from the housing 1, extend from the outside portions of the housing 1 and are electrically connected to the fixed contacts 2 and 3 in the interior of the housing 1. The fixed contacts 2 and 3 and the connecting terminals 4 are buried in the housing 1 integrally therewith by a method of insert molding or the like.

A movable contact 5 is formed of a metal material having a spring property such as stainless steel, phosphor bronze or the like in a dome shape having an apex portion 5*a* which is, when pressed from the outside, reversed in an opposite side. The lower peripheral edge 5*b* of the movable contact 5 is disposed on one of the fixed contacts, that is, on the fixed contact 2 disposed in the inner bottom of the housing 1 in electrical contact therewith. Further, the apex portion 5*a* is disposed above the other fixed contact 3 in confrontation therewith with a predetermined interval therebetween.

A plurality of projections 5*c*, which project to the dome-shaped inner surface, are formed at the apex portion 5*a* of the movable contact 5 in a scattered state and disposed at a portion excluding the dome-shaped apex portion 5*a* on an annular line. Further, the press section 6*a* of a stem 6, which will be described later, is abutted against the upper surface of the apex portion 5*a*, and the manipulating section 6*c* of the stem 6 is urged in a direction, in which it projects externally of the housing 1, by the pressure of a dome-shaped spring through the press section 6*a*.

The stem 6 is formed of a molded material such as a synthetic resin or the like in an approximate cylindrical shape. The stem 6 includes the press section 6*a*, which is abutted against the dome-shaped apex portion 5*a* of the movable contact 5 and presses the movable contact 5 in the direction of the fixed contact 3, a locking section 6*b* locked to a cover 7, which will be described later, composed of a metal sheet covering the opening of the housing 1 so as to prevent the stem 6 from flying out externally of the housing 1, and the manipulating section 6*c* which projects externally of the housing 1 and is manipulated with a finger of an operator, or the like from the outside.

The cover 7 is formed of a sheet-shaped metal sheet subjected to press work and has a through-hole 7*a*, through which the manipulating section 6*c* of the stem 6 passes, defined at the center thereof. The cover 7 is mounted on the opening of the upper surface of the housing 1 so as to prevent the stem 6 and the movable contact 5 from flying out externally of the housing 1.

Next, the operation of the above push button switch will be described. When the manipulating section 6*c* of the stem 6 is pressed with the finger of the operator or the like and the stem 6 is pushed down thereby, the press section 6*a* disposed at the lower end of the stem 6 presses the apex portion 5*a* of the movable contact 5. At the time, the dome-shaped movable contact 5 is reversed by the pressed press section 6*a* so that the plurality of projections 5*c* disposed on the inner surface portion of the apex portion 5*a* come into contact with the fixed contact 3. As a result, the fixed contact 2 is electrically connected to the fixed contact 3 through the movable contact 5.

In this case, the plurality of projections 5*c* are disposed on the inner surface of the movable contact 5 at the portion excluding the dome-shaped apex portion 5*a* on the annular line and come into contact with the fixed contact 3. Thus, the fixed contact 3 is in contact with the movable contact 5 at a position from which dust (not shown), which tends to gather at the center 3*a* of the fixed contact 3, is avoided. As a result, they are in contact with each other in a stable state and the reliability of their contact is enhanced as compared with a push button switch having such a structure that the apex portion 5*a* is in direct contact with the center 3*a* of the fixed contact 3.

Further, since the plurality of projections 5*c* are independently formed in the scattered state, the dome-shaped apex portion 5*a* located inwardly of the projections 5*c* acts as a movable region when the movable contact 5 is reversed. Accordingly, when the push button switch is manipulated, feeling in manipulation is not adversely affected thereby.

Figure 3:
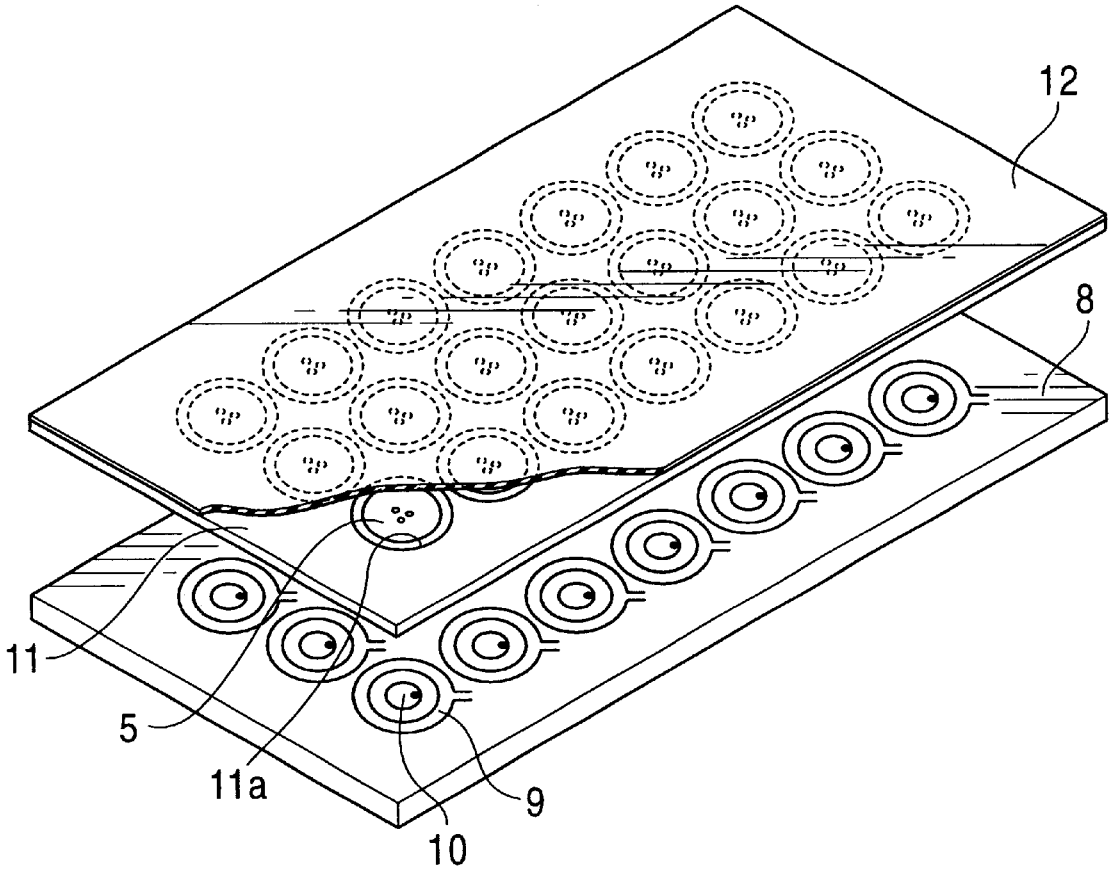
FIG. 3 is a perspective view showing the structure of a sheet type push button switch as a second embodiment of the present invention.
Figure 4:
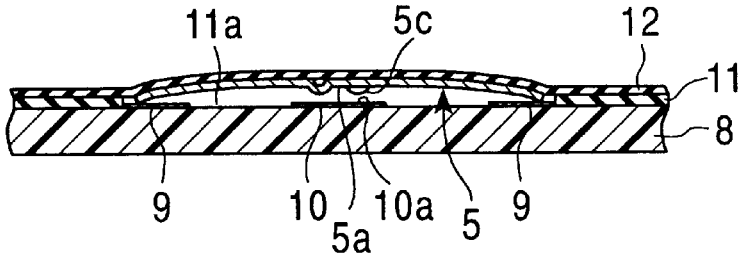
FIG. 4 is a partially detailed view showing the section of the movable contact and fixed contact of the sheet type push button switch of the present invention.
Figure 5:
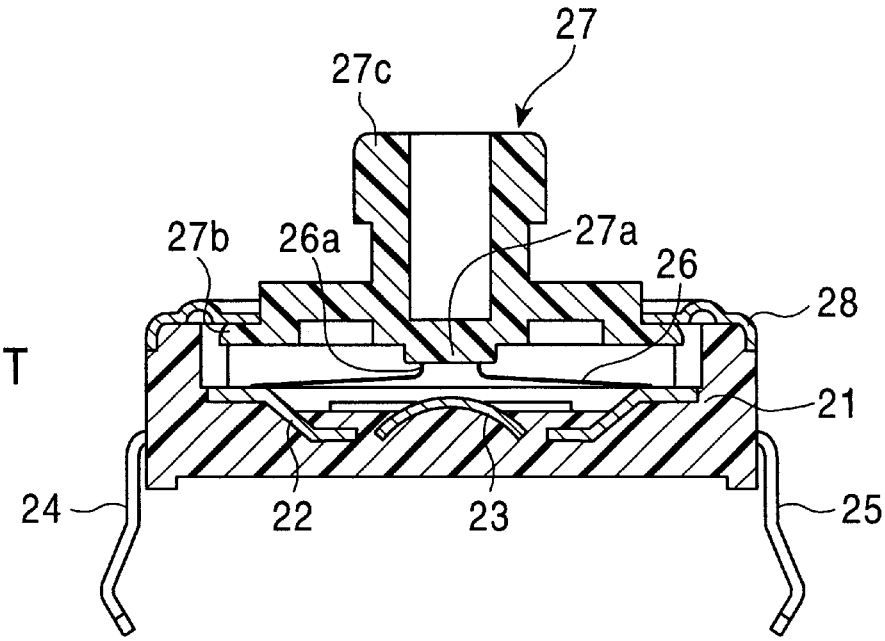
FIG. 5 PRIOR ART
FIG. 5 is a sectional view showing a conventional housing type push button switch.
Figure 6:
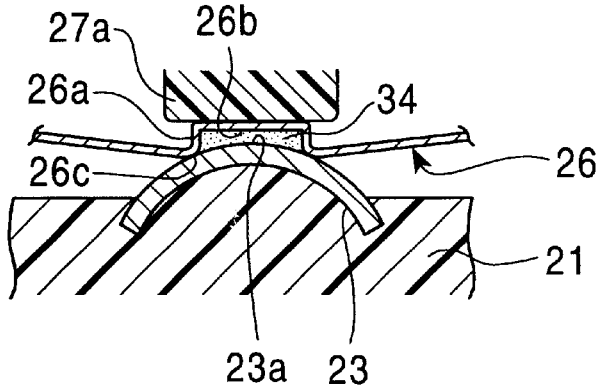
FIG. 6 PRIOR ART
FIG. 6 is a partially detailed view showing a state in which the movable contact of the conventional housing type push button switch comes into contact with a fixed contact thereof.
Figure 7:
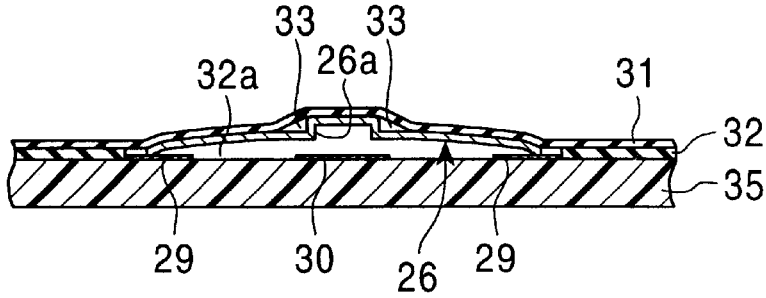
FIG. 7 PRIOR ART
FIG.7 is a partially detailed view showing a conventional sheet type movable contact and fixed contact.

FIGS. 3 and 4 show the structure of a sheet type push button switch as a second embodiment of the present invention, wherein FIG. 3 is a perspective view of the push button switch, and FIG. 4 is a partially detailed view showing the section of a movable contact and fixed contact.

Note that the same parts described in FIGS. 1 and 2 are denoted by the same numerals and the description thereof is omitted.

In the figures, a circuit board 8 is formed of an insulating laminated sheet of a phenol resin or the like. A plurality of circuit patterns of fixed contacts 9 and 10 are disposed on the circuit board 8 by printing carbon thereon or etching a copper foil or the like.

A spacer 11 is formed of an insulating material, for example, PET (polyethylene terephthalate) or the like in a sheet shape and clamped between the circuit board 8 and a sheet member 12, which will be described later so as to be adhered therebetween. The spacer 11 has an accommodating section 11*a* formed thereon in which a plurality of movable contacts 5 are accommodated and held.

The sheet member 12 is formed of PET (polyethylene terephthalate) or the like in a sheet shape and adhered on the circuit board 8 so as to cover the spacer 11, which is placed on the circuit board 8, and the movable contacts 5, which are accommodated in the accommodating section 11*a* of the spacer 11.

While the above sheet type push button may be manipulated with a finger of an operator from above the sheet member 12, another stem (not shown) or the like may be disposed on the sheet member 12 and the push button switch may be manipulated through the stem.

Also in the structure of the push button switch of the second embodiment of the present invention, since a plurality of projections 5*c* are disposed on the inner surface of each movable contact 5 at a portion excluding a dome-shaped apex portion 5*a* on an annular line in a scattered state and come into contact with the fixed contact 10. Thus, the fixed contact 10 is in contact with the movable contact 5 at a position from which dust, which tends to gather at the center 10*a* of the fixed contact 10, is avoided. As a result, they are in contact with each other in a stable state and the reliability of their contact is enhanced as compared with a push button switch having such a structure that the apex portion 5*a* is in direct contact with the center 10*a* of the fixed contact 10.

Further, since the plurality of projections 5*c* are independently formed in the scattered state, the dome-shaped apex portion 5*a* located inwardly of the projections 5*c* acts as a movable region when the movable contact 5 is reversed. Accordingly, when the push button switch is manipulated, feeling in manipulation is not adversely affected thereby.

Further, since no projection projects upward on the side of the upper surface of the dome-shaped apex portion 5*a* of the movable contact 5 in the structure of the push button switch of the second embodiment of the present invention, the movable contact 5 is in good intimate contact with the sheet member 12 and no gap is made therebetween, whereby reliable adhesion can be realized and the reliability and outside appearance property of a product can be enhanced.

Note that while the plurality of projections 5*c* are disposed on the annular line in the embodiments of the present invention, they need not be always disposed on the annular line so long as they are disposed at a portion excluding the dome-shaped apex portion 5*a* and may be disposed on a linear line in a scattered state. Further, one piece of the projection 5*c* may be provided in place of the plurality of them. It is needless to say that the same effect as that of the above embodiment of the present invention can be obtained also in this case.

As described above, since the projections, which can be in contact with and separated from the fixed contact, are formed at the portion excluding the dome-shaped apex portion in the structure of the dome-shaped movable contact of the present invention, the fixed contact comes into contact with the movable contact at the position from which dust, which tends to gather at the center of the fixed contact, is avoided. Therefore, the contact is stably performed and the reliability of the contact is enhanced as compared with the structure in which the apex portion is in direct contact with the center of the fixed contact.

In the structure of the housing type push button switch having the stem provided with the dome-shaped movable contact of the present invention, the projections, which can be in contact with and separated from the fixed contact, are disposed on the inner surface of the movable contact at the portion excluding the dome-shaped apex portion and the plurality of projections are formed independently. Thus, since the dome-shaped apex portion located inwardly of the projections also acts as the movable region when the movable contact is reversed, when the push button switch is manipulated, feeling in manipulation is not adversely affected thereby and the feeling in manipulation is enhanced.

In the structure of the sheet type push button switch provided with the dome-shaped movable contact of the present invention, the projections, which can be in contact with and separated from the fixed contact, are disposed on the inner surface of the movable contact at the portion excluding the dome-shaped apex portion and no projection projects upward on the side of the upper surface of the dome-shaped apex portion of the movable contact. Thus, the movable contact is in good intimate contact with the sheet member and no gap is made therebetween, whereby reliable adhesion can be realized and the reliability and outside appearance property of a product can be enhanced.

Since the plurality of projections are disposed on the dome-shaped inner surface in the scattered state, the movable contact comes into contact with the fixed contact at a plurality of positions, whereby the contact is stabilized and the reliability thereof is enhanced.

Further, since the plurality of projections are disposed on the annular line, even if, for example, the position where the dome-shaped apex portion is manipulated is displaced and the apex portion is pressed at an edge or obliquely, contact can be stably carried out.

What is claimed is:

1. A push button switch, comprising:

fixed contacts;

a dome-shaped movable contact disposed above said fixed contacts and having a dome-shaped apex portion;

a projection formed on an inner surface of said movable contact at a portion excluding said dome-shaped apex portion so as to be in contact with and separated from one of said fixed contacts;

a housing;

said fixed contacts disposed on an inner bottom of said housing;

said movable contact formed of a metal material having a spring property;

a stem movably disposed to said housing;

a plurality of projections disposed on said dome-shaped inner surface in a scattered state at positions where they can come into contact with the portion around the center of the fixed contact excluding the center;

said plurality of projections independently formed in said scattered state;

said dome-shaped apex portion of said movable contact disposed inwardly of said projections acts as a movable region when said movable contact is reversed;

a press section disposed at the lower end of said stem and abutted against said dome-shaped apex portion of said movable contact; and said stem being urged in a direction to project externally of said housing by the pressure of a dome-shaped spring through said press section.

2. A push button switch according to claim 1, further comprising:

a circuit board;

said fixed contacts disposed on said circuit board;

said dome-shaped movable contact disposed above said fixed contacts;

a sheet member adhered on said circuit board through a sheet-like spacer, which is formed of an insulating material;

said sheet member covers said sheet-like spacer and said movable contacts, which are accommodated in an accommodating section of said sheet-like spacer; and wherein said stem pushes a portion of said sheet member to manipulate said movable contact.

3. A push button switch according to claim 1, wherein a plurality of projections are disposed on an annular line.

4. A push button switch, comprising:

fixed contacts;

a dome-shaped movable contact disposed above said fixed contacts and having a dome-shaped apex portion;

said movable contact is formed of a metal material having a spring property;

a projection formed on an inner surface of said movable contact at a portion excluding said dome-shaped apex portion so as to be in contact with and separated from one of said fixed contacts;

a circuit board;

said fixed contacts disposed on said circuit board;

a sheet member adhered on said circuit board;

said movable contact is covered with said sheet member; and wherein a plurality of projections are disposed on said dome-shaped inner surface in a scattered state.

5. A push button switch according to claim 4, wherein a plurality of projections are disposed on an annular line.

6. A push button switch according to claim 4, wherein said sheet member adhered on said circuit board through a sheet-like spacer, which is formed of an insulating material; and said sheet member covers said sheet-like spacer and said movable contacts, which are accommodated in an accommodating section of said sheet-like spacer.

* * * * *